US009648404B2

(12) United States Patent
Li et al.

(10) Patent No.: US 9,648,404 B2
(45) Date of Patent: May 9, 2017

(54) SPEAKER MODULE AND ASSEMBLING METHOD OF THE SPEAKER MODULE

(71) Applicant: Goertek, Inc., Weifang, ShanDong Province (CN)

(72) Inventors: Zhaopeng Li, Weifang (CN); Xueping Song, Weifang (CN); Huawei Liu, Weifang (CN)

(73) Assignee: GOERTEK, INC., Weifang, Shandong Province (CN)

( * ) Notice: Subject to any disclaimer, the term of this patent is extended or adjusted under 35 U.S.C. 154(b) by 69 days.

(21) Appl. No.: 14/769,979

(22) PCT Filed: Mar. 27, 2015

(86) PCT No.: PCT/CN2015/075193
§ 371 (c)(1),
(2) Date: Aug. 24, 2015

(87) PCT Pub. No.: WO2016/008315
PCT Pub. Date: Jan. 21, 2016

(65) Prior Publication Data

US 2016/0316287 A1 Oct. 27, 2016

(30) Foreign Application Priority Data

Jul. 17, 2014 (CN) ..... 2014 1 0341650

(51) Int. Cl.
*H04R 9/06* (2006.01)
*H04R 1/02* (2006.01)

(52) U.S. Cl.
CPC ..... *H04R 1/025* (2013.01); *H04R 9/06* (2013.01); *H04R 2201/029* (2013.01); *H04R 2499/11* (2013.01)

(58) Field of Classification Search
CPC .... H04R 9/06; H04R 2201/029; H04R 1/025; H04R 2499/11
See application file for complete search history.

(56) References Cited

U.S. PATENT DOCUMENTS

2007/0265029 A1* 11/2007 Tsai ..... H04M 1/035 455/550.1
2015/0195638 A1* 7/2015 Tseng ..... H04R 1/1016 381/380

* cited by examiner

*Primary Examiner* — Muhammad N Edun
(74) *Attorney, Agent, or Firm* — Boyle Fredrickson, S.C.

(57) ABSTRACT

The present invention discloses a speaker module and an assembling method of the speaker module and relates to the technical field of electroacoustic products. The structure of the housing of the module is improved in the present invention, so that first performing the ultrasonic welding between the shells, then mounting the speaker monomer into the inner cavity of the module and at last sealing the front acoustic cavity by coating the glue are realized, which effectively solves the disadvantages caused by first mounting the speaker monomer and then performing ultrasonic welding in prior art. According to the present invention, in the course of the assembling, the occurrence of the problems of the damage of the speaker monomer, the deformation or breaking of the shells and the leakage of the front and the rear acoustic cavity is avoided, and the end products of the speaker modules of the present invention have a high qualified rate.

10 Claims, 5 Drawing Sheets

SPEAKER MODULE AND ASSEMBLING METHOD OF THE SPEAKER MODULE

TECHNICAL FIELD

The present invention relates to the technical field of electro-acoustic products, in particular to a speaker module and an assembling method of the speaker module.

BACKGROUND ART

A speaker module is an important acoustic part of a portable electronic device for completing the conversion between an electrical signal and a sound signal and is an energy conversion device.

The speaker module includes a housing within which a speaker monomer is contained, the speaker monomer includes a vibration system and a magnetic system; the housing of the module is generally made by combining at least two plastic shells. When the speaker module of this kind of structure is assembled, it is needed first to fix the speaker monomer to one of the shells, and then to weld two plastic shells as one by ultrasonic welding process, so as to complete the assembly of the speaker module. When assembling, the above assembling process will result in disadvantages such as damage to the speaker monomer, leak of the speaker monomer, etc., which is mainly represented by the following:

1. during the ultrasonic welding, the speaker monomer may often be damaged by the ultrasound machine;
2. for some speaker modules with an insufficient space of height, during ultrasonic welding, the shells may be squeezed by the speaker monomer, the plastic shells may be prone to deform, even break;
3. because in the ultrasonic welding, the welding is achieved by high-frequency vibration, the sealant coated on the periphery of the speaker monomer for sealing the front acoustic cavity and the rear acoustic cavity of the module may fail under the effect of the high-frequency vibrations, which may result in an untight sealing and leakage.

For the above technical problems, there is no good solution in the art at present.

SUMMARY OF THE INVENTION

In view of the above disadvantages, a first technical problem to be solved by the present invention is to provide a speaker module, which in the course of the assembling, avoids the occurrence of the disadvantages of damage of the speaker monomer, deformation or breaking of the shells of the module or leakage of the front and the rear acoustic cavity of the module, so that the end products of the modules have a high qualified rate.

Based on the same inventive concept, a second technical problem to be solved by the present invention is to provide an assembling method of a speaker module, which can avoid the disadvantages of damage of the speaker monomer, deformation or breaking of the shells of the module or leakage of the front and the rear acoustic cavity of the module caused by the ultrasonic welding, so that the produced end products of the modules have a high qualified rate.

To solve the above-said first technical problem, the technical solution of the present invention is:

A speaker module includes a housing, a speaker monomer being contained within the housing and the housing including a first shell and a second shell combined together, two buckle structures for buckling the speaker monomer are provided on the second shell, the two buckle structures having a transverse elasticity; a mounting hole is provided at the position on the first shell corresponding to the two buckle structures, the speaker monomer being mounted into a cavity of the module through the mounting hole and being buckled between the two buckle structures, and a third shell being covered at the mounting hole; a front acoustic cavity of the module is surrounded by the first shell, the third shell and the speaker monomer together, and a rear acoustic cavity of the module is surrounded by the first shell, the second shell and the speaker monomer together.

Wherein, the third shell is a steel sheet.

As an embodiment, a sounding hole of the module is located in a side portion of the speaker monomer and is provided between the first shell and the second shell, and through holes for communicating the front acoustic cavity and the sounding hole are provided on the first shell located in a side portion of the mounting hole.

As another embodiment, a sounding hole of the module is located on the third shell, and the sounding hole is located in the range of the front projection of the speaker monomer.

Wherein, avoiding grooves are provided at both positions on a side wall of the mounting hole corresponding to the two buckle structures, the two buckle structures being respectively located within the corresponding avoiding grooves.

Wherein, several protruding positioning ribs are provided at the positions on the side wall of the mounting hole where there is no avoiding grooves provided, a boss is provided between the two adjacent positioning ribs, and a glue coating groove for sealing the front acoustic cavity and the rear acoustic cavity is formed between the positioning ribs and the speaker monomer, and between the boss and the speaker monomer.

Wherein, the buckle structures include a connection portion perpendicular to the bottom of the second shell, the connection portion having a transverse elasticity, the end portion of the connection portion being provided with a buckle portion which is perpendicular to the connection portion and extends toward the direction of the speaker monomer, and the buckle portion being buckled on the end face of the speaker monomer.

Wherein, a slot adapted to the buckle portion is provided on the end face of the speaker monomer.

Wherein, the steel sheet includes a steel sheet body, side wings which are parallel to the steel sheet body and lower than the steel sheet body being provided in the periphery of the steel sheet body, the steel sheet body being integrated with the side wings through a side wall, and a glue receiving groove being formed between the side wall, the side wings and the first shell.

To solve the above second technical problem, the technical solution of the present invention is:

A method for assembling the speaker module includes steps of a S1, providing the first shell and the second shell, and welding the first shell and the second shell as one by ultrasonic process; S2, mounting the speaker monomer, in a direction downward along a magnetic system, between the two buckle structures from the mounting hole; S3, coating glue between the speaker monomer and the first shell to seal the front acoustic cavity and the rear acoustic cavity; S4, placing the third shell at the mounting hole above the speaker monomer, and coating the glue between the third shell and the first shell to perform sealing, thus completing the assembling of the speaker module.

After adopting the above technical solutions, the beneficial effects of the present invention are:

Because two buckle structures for buckling the speaker monomer are provided on the second shell of the speaker module of the present invention, and the two buckle structures have transverse elasticity; a mounting hole for mounting the speaker monomer between the two buckle structures is provided at the position on the first shell corresponding to the two buckle structures, and a third shell is covered at the mounting hole. When assembling, such a structure of the speaker module can first combine the first shell and the second shell as one by ultrasonic welding and then press the speaker monomer downward along the magnetic system from the mounting hole into the shells. Because the buckle structures have a transverse elasticity, when the speaker monomer moves downward, the buckle structures will expand to both sides of the speaker. When the speaker monomer fully enters into the shells, the buckle structures will rebound to buckle the speaker, which plays a role of fixation of the speaker monomer. Then, the glue is coated between the speaker monomer and the shells to seal the front acoustic cavity and the rear acoustic cavity. At last, a third shell is covered at the mounting hole and fixed and sealed with the first shell by coating the glue. It can be known from the above-said assembling sequence, in the speaker module of the present invention, first the ultrasonic welding is performed between the shells, and then the speaker monomer is mounted into the shells, thus avoiding the disadvantages of the damage of the speaker monomer, the deformation or breaking of the shells of the module or the leakage of the front and the rear acoustic cavity of the module caused when performing the ultrasonic welding, so that the end products of the modules have a high qualified rate.

Because the assembling method of the speaker module of the present invention is first performing the ultrasonic welding between the shells, then mounting the speaker monomer into the inner cavity of the module, and at last sealing by coating the glue, the assembling method of the speaker module of the present invention can avoid the disadvantages of the damage of the speaker monomer, the deformation or breaking of the shells of the module or the leakage of the front and the rear acoustic cavity of the module caused by ultrasonic welding, so that the end products of the modules have a high qualified rate.

In summary, the speaker module and the assembling method thereof of the present invention solve the technical problems in the art that the damage of the speaker monomer, the deformation or even breaking of the shells of the module and the leakage of the front and the rear acoustic cavity of the module are prone to occur in the assembling of the speaker module. The speaker module and the assembling method thereof of the present invention effectively solve the above-said technical problems and increase the qualified rate of the end products of the speaker modules.

The above explanation is merely an outline of the technical solution of the present application. In order to be able to understand the technical means of the present application more clearly and to be able to implement it in accordance with the contents of the specification, and in order to enable the above-said and other objectives, features and advantages of the present application more evident and comprehensible, the specific embodiments of the present application are particularly described in the following.

BRIEF DESCRIPTION OF DRAWINGS

By the following description of the present invention in conjunction of the attached drawings, the above-said features and technical advantages of the present invention will become clearer and understandable.

Figure 1:
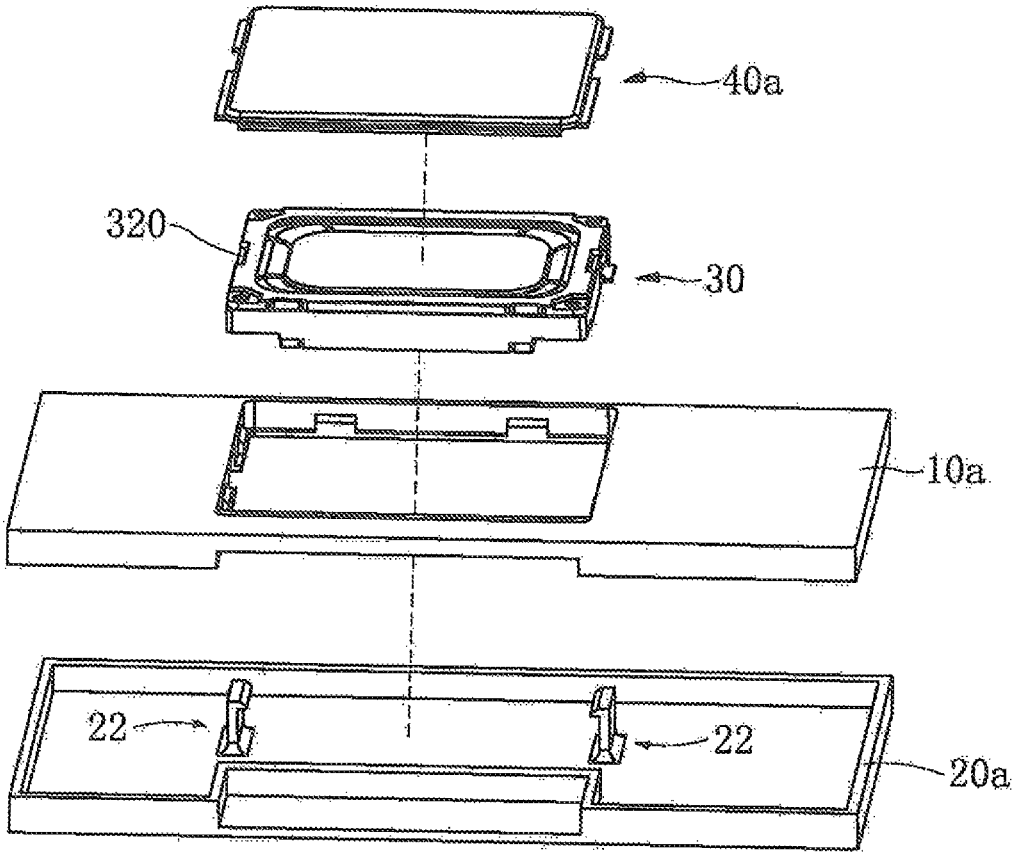
FIG. 1 is a perspective exploded schematic view of the structure of an Embodiment 1 of a speaker module of the present invention.

In the drawings: 10*a* a first shell, 10*b* a first shell, 100 a mounting hole, 12 an avoiding groove, 14 positioning ribs, 16 a boss, 18 through holes, 20*a* a second shell, 20*b* a second shell, 22 buckle structures, 220 a buckle portion, 222 a connection portion, 224 an inclined plane, 30 a speaker monomer, 32 a monomer front cover, 320 a slot, 34 a monomer housing, 360 a dome, 362 a diaphragm, 364 a voice coil, 380 a magnetic permeability plate, 382 an inner magnet, 384 an outer magnet; 386 an inner washer, 388 an outer washer, 40*a* a steel sheet, 40*b* a steel sheet, 42*a* a steel sheet body, 42*b* a steel sheet body, 44 side wings, 46 a side wall, 50*a* a sounding hole. 50*b* a sounding hole, 60 a glue receiving groove, 62 a glue coating groove, 70 a front acoustic cavity, 72 a rear acoustic cavity.

DETAILED DESCRIPTION OF THE INVENTION

Herein below, the present invention will be further elaborated in connection with the attached drawings and embodiments.

In the following description, certain exemplary embodiments of the present invention are only described in an illustrative way. Needless to say, those ordinary skilled in the art can recognize that, the embodiments can be modified in various different ways without departing from the spirit and scope of the present invention. Therefore, the attached drawings and description are in an illustrative nature, and not for limiting the protection scope of the claims. In the present specification, the same reference numerals indicate the same or similar part.

Embodiment 1

Figure 2:
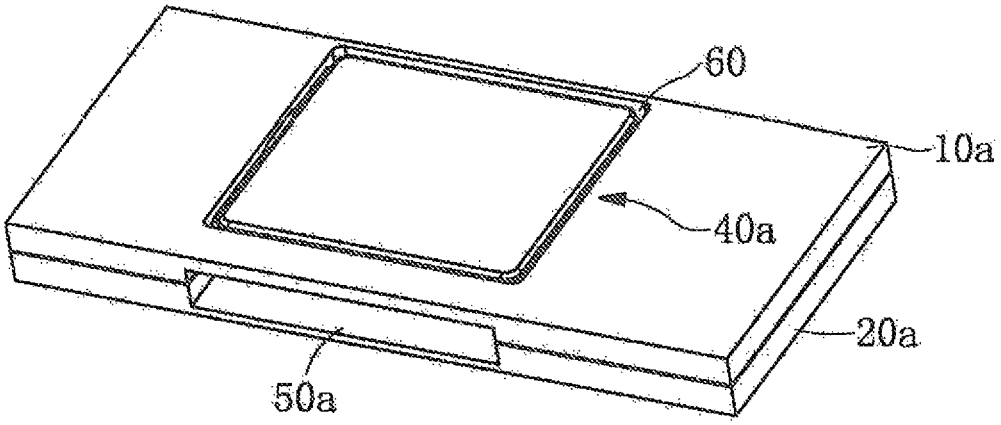
FIG. 2 is an assembled view of FIG. 1.
Figure 4:
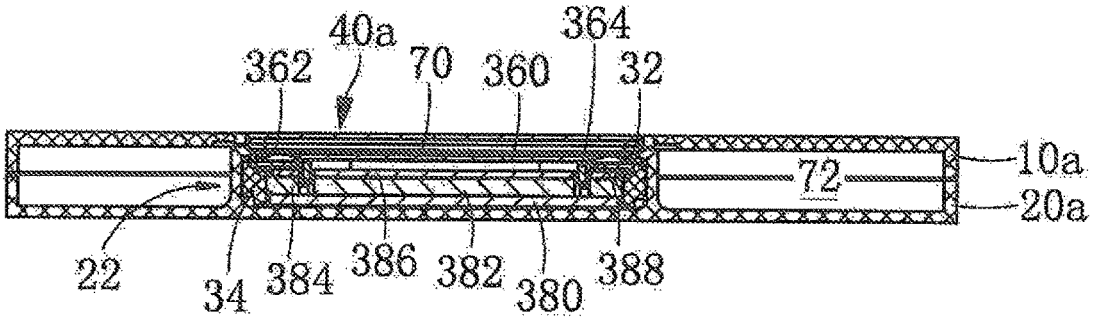
FIG. 4 is a sectional view taken along line A-A of FIG. 3.

As commonly shown in FIG. 1 and FIG. 2, a speaker module includes a third shell, a first shell 10*a* and a second shell 20*a* which are sequentially combined together, wherein, the third shell is a steel sheet 40*a*, and a speaker monomer 30 is contained within a space together surrounded by the steel sheet 40*a*, the first shell 10*a* and the second shell 20*a*. The module is of a structure of side sounding. A sounding hole 50*a* is located on one side of the speaker monomer 30 and surrounded together by the first shell 10*a* and the second shell 20*a*. A front acoustic cavity 70 (as shown in FIG. 4) of the module is surrounded together by the first shell 10*a*, the steel sheet 40*a* and the speaker monomer 30, and a rear acoustic cavity 72 (as shown in FIG. 4) of the module is surrounded together by the first shell 10*a*, the second shell 20*a* and the speaker monomer 30. The first shell 10*a* and the second shell 20*a* are fixed and sealed by a ultrasonic welding process, and the steel sheet 40*a* and the first shell 10*a* are fixed and sealed by glue.

Figure 3:
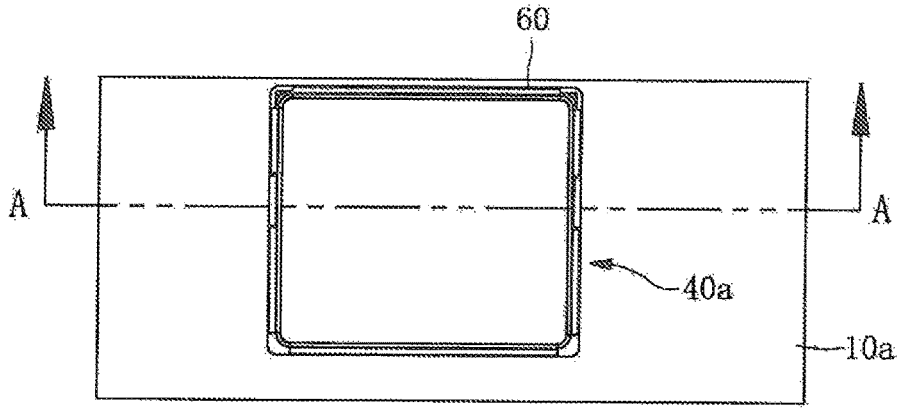
FIG. 3 is a front projection view of FIG. 2.

As commonly shown in FIG. 3 and FIG. 4, the speaker monomer 30 includes a monomer front cover 32 and a monomer housing 34 combined together. A vibration system and a magnetic system are contained within a space surrounded by the monomer front cover 32 and the monomer housing 34. The vibration system includes a diaphragm 362, the edge portion of which is fixed between the monomer front cover 32 and the monomer housing 34. A dome 360 is fixed in the middle portion of one side of the diaphragm 362 near the monomer front cover 32, and a voice coil 364 is fixed on another side of the diaphragm 362. The magnetic system includes a magnetic permeability plate 380 fixed on the monomer housing 34. An inner magnet 382 and an inner washer 386 are sequentially fixed in the central position inside the magnetic permeability plate 380, and an outer magnet 384 and an outer washer 388 are sequentially fixed in the edge position inside the magnetic permeability plate 380. A magnetic gap is provided between the inner magnet 382 and the inner washer 386, and between the outer magnet 384 and the outer washer 388. The end portion of the voice coil 364 is located within the magnetic gap. The voice coil 364 makes a reciprocating movement of cutting magnetic field lines in the magnetic gap in accordance with the magnitude and direction of the alternating current passing through the windings thereof. The diaphragm 362 vibrates along with the reciprocating movement of the voice coil 364, driving the air to sound, so as to complete the electro-acoustic energy conversion.

As commonly shown in FIG. 1, FIG. 4, FIG. 7 and FIG. 8, the speaker monomer 30 is fixed by two buckle structures 22 provided inside the second shell 20*a*. The two buckle structures 22 are respectively provided on both sides of the speaker monomer 30, for positioning of the speaker monomer 30 in a Z direction (height direction). The two buckle structures 22 are both integrated with the second shell 20*a* and provided symmetrically on both side of the speaker monomer 30. The buckle structures 22 include a connection portion 222 perpendicular to the bottom of the second shell 20*a*. The end portion of the connection portion 222 is provided with a buckle portion 220, which is perpendicular to the connection portion 222 and extends toward the direction of the speaker monomer 30. On one side of the buckle portion 220 near the speaker monomer 30 is an inclined plane 224 extending toward the direction of the speaker monomer 30 and the connection portion 222 has a transverse elasticity. When the speaker monomer 30 moves by an external force from the outer of the buckle structures 22 to the inner thereof, the inclined plane 224 will play a role of guidance. After squeezed by the speaker monomer 30, the buckle portion 220 will expand to both sides under the effect of the elastic force of the connection portion 222, till the speaker monomer 30 is fully pressed into the buckle structures 22. The buckle portion 220 will be restored under the effect of the elastic force of the connection portion 222 and buckled on the end face of the monomer front cover 32 of the speaker monomer 30. A slot 320 adapted to the size and shape of the buckle portion 220 is provided at a position on the end face of the monomer front cover 32 corresponding to the buckle portion 220, and the buckle portion 220 is buckled within the slot 320. The slot 320 not only plays a role of positioning of the buckle portion 220, but also taking a good advantage of the thickness of the monomer front cover 32, thereby reducing the thickness of the module.

As commonly shown in FIG. 1, FIG. 6, FIG. 9 and FIG. 10, a mounting hole 100 is provided at the positions on the first shell 10*a* corresponding to the buckle structures 22. After the first shell 10*a* and the second shell 20*a* are first integrated by the ultrasonic welding and sealing, the speaker monomer 30 is mounted between the two buckle structures 22 (i.e. in the inner cavity of the module) from the mounting hole 100, the size and shape of the mounting hole 100 is consistent with those of the speaker monomer 30. A side wall integrated with the first shell 10*a* is provided in the periphery of the mounting hole 100. Avoiding grooves 12 adapted to the size and shape of the buckle structures 22 are respectively provided at the positions of the side wall corresponding to the two buckle structures 22. After the first shell 10*a* and the second shell 20*a* are combined and sealed, the buckle structures 22 are located within the avoiding grooves 12. Several protruding positioning ribs 14 are provided at the positions on the side wall where there is no avoiding grooves 12 provided. The positioning ribs 14 are used for positioning of the speaker monomer 30 in X and Y directions (width and length directions). A boss 16 is provided on the side wall between the two adjacent positioning ribs 14, the boss 16 is flush with the surface of the positioning ribs 14 relative to the surface of one side of the speaker monomer 30, and the height of the boss 16 is lower than that of the positioning ribs 14. After the speaker monomer 30 is mounted into the inner cavity of the module, a glue coating groove 62 is formed between the speaker monomer 30 and the boss 16 and between the positioning ribs 14 and the boss 16. The glue is coated into the glue coating groove 62 to realize the sealing between the front acoustic cavity 70 and the rear acoustic cavity 72 (as shown in FIG. 4) of the speaker module.

Figure 5:
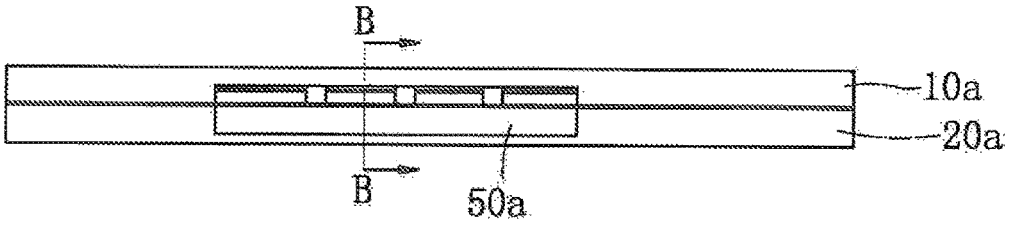
FIG. 5 is a bottom view of FIG. 3.
Figure 6:
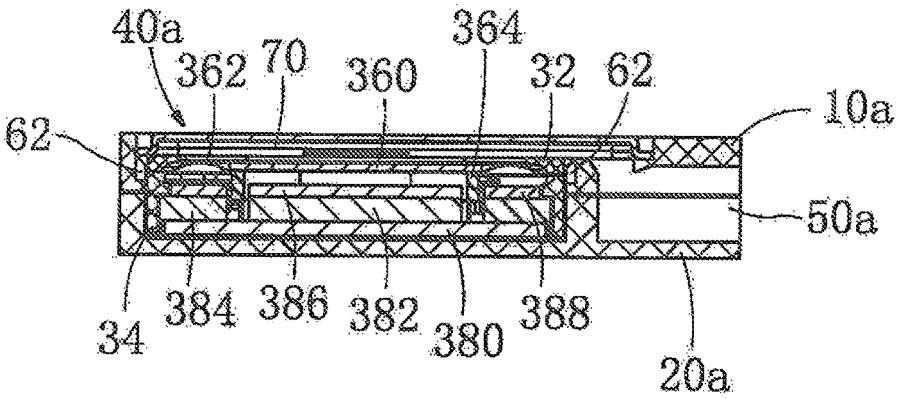
FIG. 6 is a sectional view taken along line B-B of FIG. 5.
Figure 7:
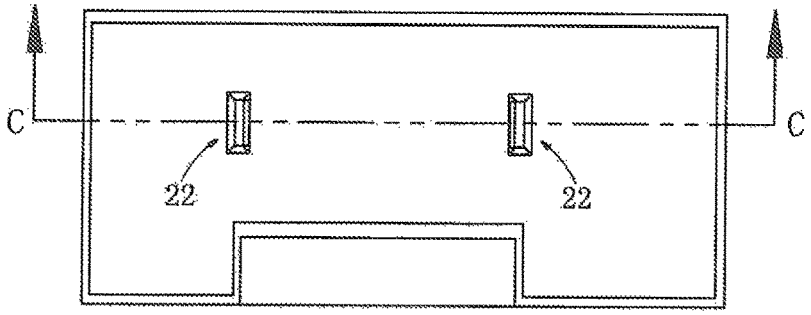
FIG. 7 is a schematic view of the structure of a second shell in FIG. 1.
Figure 8:
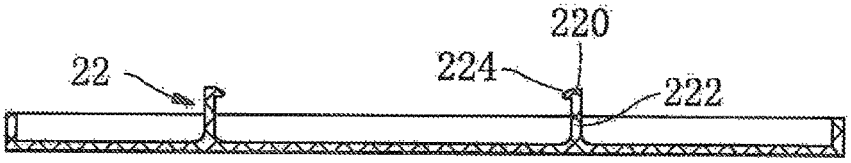
FIG. 8 is a sectional view taken along line C-C of FIG. 7.
Figure 9:
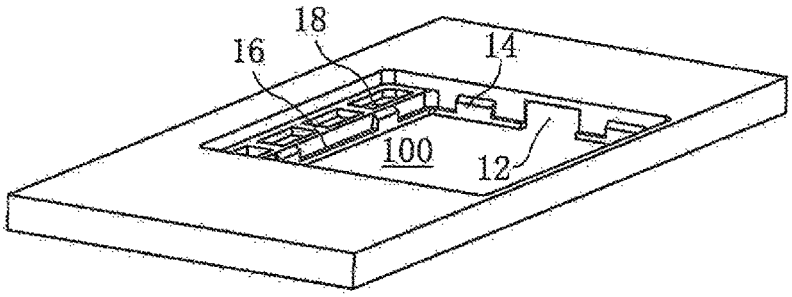
FIG. 9 is a perspective schematic view of the structure of a first shell in FIG. 1.
Figure 10:
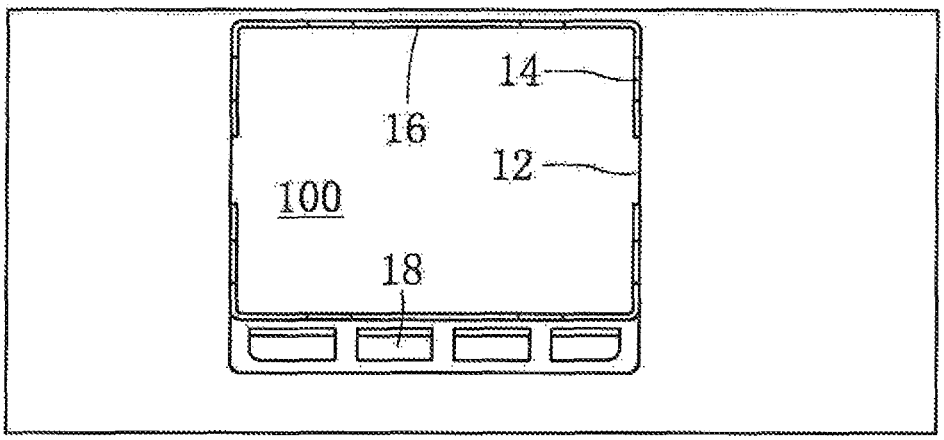
FIG. 10 is a schematic plan view of the structure of the first shell in FIG. 1.
Figure 11:
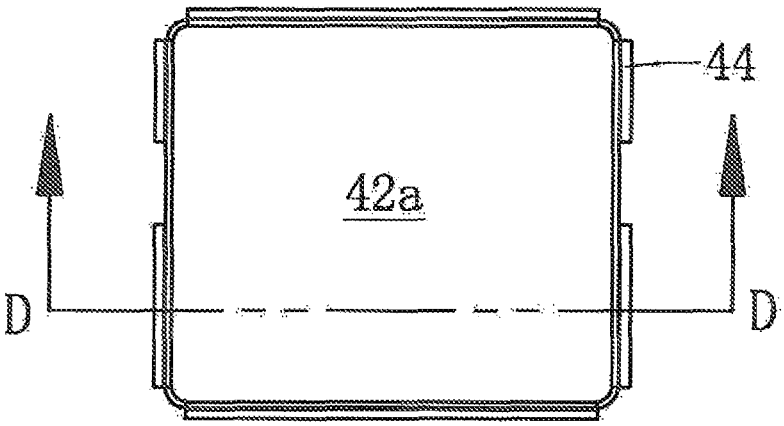
FIG. 11 is a schematic view of the structure of a steel sheet in FIG. 1.
Figure 12:
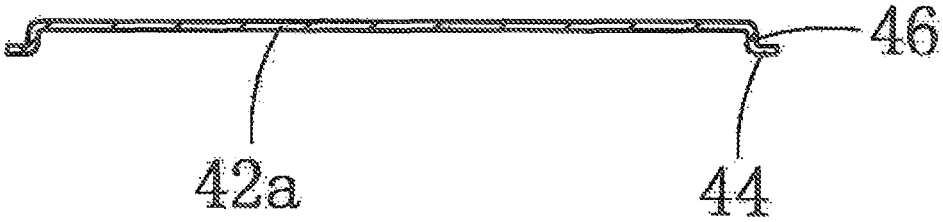
FIG. 12 is a sectional view taken along line D-D of FIG. 11.

As commonly shown in FIG. 5, FIG. 6 and FIG. 9, the sounding hole 50*a* of the module is provided on one side and located between the first shell 10*a* and the second shell 20*a*. Through holes 18 for communicating the front acoustic cavity 70 and the sounding hole 50*a* are provided on the first shell 10*a*. The through holes 18 are provided on one side of the mounting hole 100 near the sounding hole 50*a*. Four through holes 18 are provided side by side near the side wall of the mounting hole 100, and the end faces of the four through holes 18 for communicating the front acoustic cavity 70 is in height identical to the end faces of the positioning ribs 14 and all lower than the outer surface of the first shell 10*a*. The opening direction of the through holes 18 is perpendicular to the surface of the first shell 10*a*.

As commonly shown in FIG. 2, FIG. 3, FIG. 11 and FIG. 12, the steel sheet 40*a* includes a steel sheet body 42*a*. Side wings 44 are provided on the periphery of the steel sheet body 42*a*. The side wings 44 are parallel to the steel sheet body 42*a* and lower than the surface of the steel sheet body 42*a*. The steel sheet body 42*a* is integrated with the side wings 44 through a side wall 46. The steel sheet body 42*a*, the side wall 46 and the side wings 44 are integrated and made by stamping a thin steel plate. After the steel sheet 40*a* covers the mounting hole 100 with the speaker monomer 30 as a support, a glue receiving groove 60 is formed among the side wall 46, the side wings 44 and the side wall of the mounting hole 100. The glue is coated within the glue receiving groove 60 to realize the fixation between the steel sheet 40*a* and the first shell 10*a* and the sealing of the front acoustic cavity 70 (as shown in FIG. 4).

Embodiment 2

Figure 13:
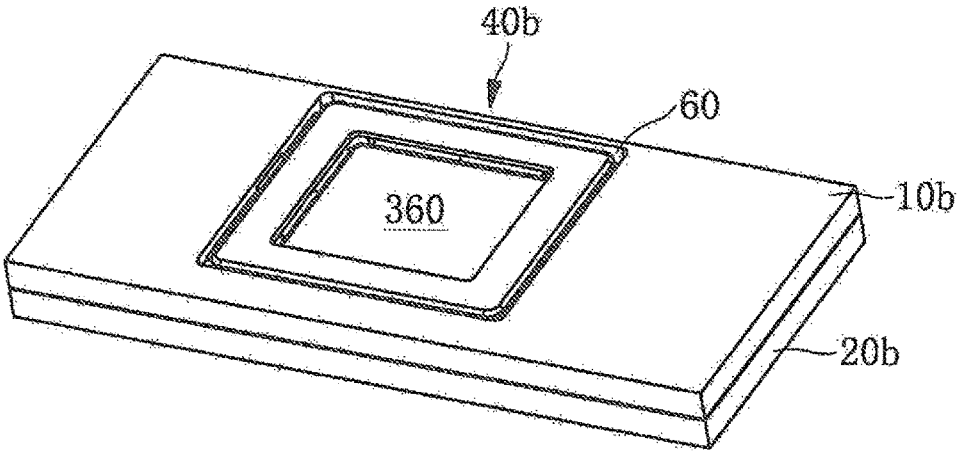
FIG. 13 is a schematic view of the structure of an Embodiment 2 of the speaker module of the present invention.
Figure 14:
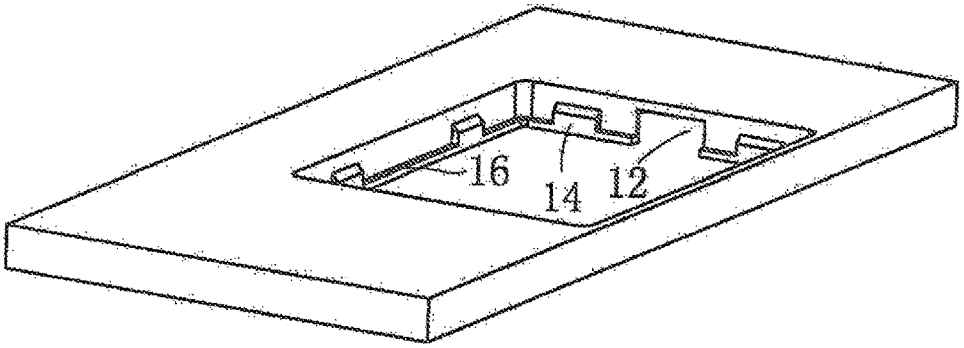
FIG. 14 is a schematic view of the structure of a first shell in FIG. 13.
Figure 15:
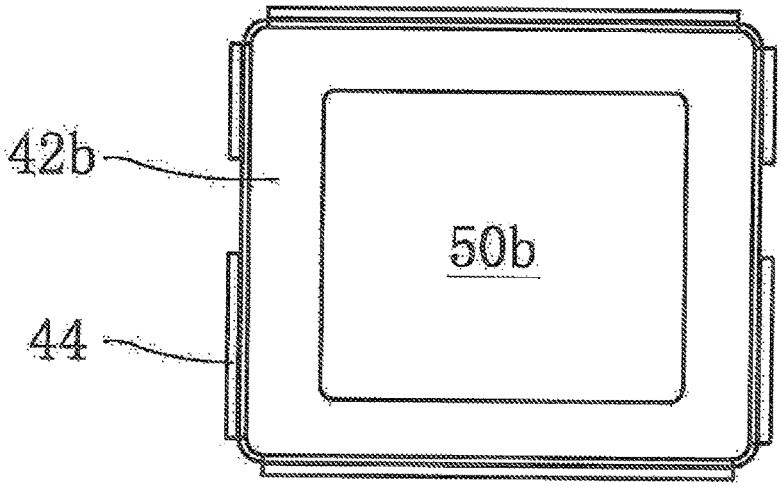
FIG. 15 is a schematic view of the structure of a steel sheet in FIG. 13.

As commonly shown in FIG. 13, FIG. 14 and FIG. 15, the present embodiment is substantially the same as the Embodiment 1 with the following differences:

A speaker monomer is contained within a space surrounded by a steel sheet 40*b*, a first shell 10*b* and a second shell 20*b*, the module is of a front sounding structure, a sounding hole 50*b* is provided in a middle position of a steel sheet body 42*b*, and the sounding hole 50*b* is located in the range of the front projection of the speaker monomer.

Because the sounding hole 40*b* is provided in the range of the front projection of the speaker monomer and sounds direct from the front acoustic cavity, there is no need to provide through holes on the first shell 10*b*, which simplified the structure of the shells.

The assembling method of the above speaker module includes the steps of:

S1, providing a first shell and a second shell, and welding the first shell and the second shell as one by ultrasonic process;

S2, aligning a speaker monomer with the position of a mounting hole downward along a magnetic system and applying a downward pressure thereto, to mount the speaker monomer between two buckle structures from the mounting hole;

S3, coating glue within a glue coating groove formed between the speaker monomer and the first shell to seal a front acoustic cavity and a rear acoustic cavity;

S4, placing a steel sheet at the mounting hole above the speaker monomer to be supported by the speaker monomer, and coating the glue within a glue receiving groove formed between the steel sheet and the first shell to seal the front acoustic cavity, thus completing the assembling of the whole speaker module.

It can be known from the above-said structure and assembling method, the structure of the housing of the module is improved in the present invention, so that first performing the ultrasonic welding between the shells, then mounting the speaker monomer into the inner cavity of the module and at last sealing the front acoustic cavity by coating the glue are realized, which effectively solves the disadvantages caused by first mounting the speaker monomer and then performing ultrasonic welding in prior art. According to the present invention, in the course of the assembling, the problems of the damage of the speaker monomer, the deformation or breaking of the shells and the leakage of the front and the rear acoustic cavity will not occur, and the end products of the speaker modules of the present invention have a high qualified rate.

The present invention is not limited to the above specific embodiment, and various modifications made by those ordinary skilled in the art starting from the above idea and without creative labor all fall into the protection scope of the present invention.

The invention claimed is:

1. A speaker module including a housing, a speaker monomer being contained within the housing and the housing including a first shell and a second shell combined together, characterized in that, two buckle structures for buckling the speaker monomer are provided on the second shell, the two buckle structures having a transverse elasticity; a mounting hole is provided at the position on the first shell corresponding to the two buckle structures, the speaker monomer being mounted into a cavity of the module through the mounting hole and being buckled between the two buckle structures, and a third shell being covered at the mounting hole; a front acoustic cavity of the module is surrounded by the first shell, the third shell and the speaker monomer together, and a rear acoustic cavity of the module is surrounded by the first shell, the second shell and the speaker monomer together.

2. The speaker module according to claim 1, characterized in that, the third shell is a steel sheet.

3. The speaker module according to claim 2, characterized in that, the steel sheet includes a steel sheet body, side wings which are parallel to the steel sheet body and lower than the steel sheet body being provided in the periphery of the steel sheet body, the steel sheet body being integrated with the side wings as one through a side wall, and a glue receiving groove being formed among the side wall, the side wings and the first shell.

4. The speaker module according to claim 1, characterized in that, a sounding hole of the module is located in a side portion of the speaker monomer and is provided between the first shell and the second shell, and through holes for communicating the front acoustic cavity and the sounding hole are provided on the first shell located in a side portion of the mounting hole.

5. The speaker module according to claim 1, characterized in that, a sounding hole of the module is located in the third shell, and the sounding hole is located in the range of the front projection of the speaker monomer.

6. The speaker module according to claim 1, characterized in that, avoiding grooves are provided at both positions on a side wall of the mounting hole corresponding to the two buckle structures, the two buckle structures being respectively located within the corresponding avoiding grooves.

7. The speaker module according to claim 6, characterized in that, several protruding positioning ribs are provided at the positions on the side wall of the mounting hole where there is no avoiding grooves provided, a boss is provided between the two adjacent positioning ribs, and a glue coating groove for sealing the front acoustic cavity and the rear acoustic cavity is formed between the positioning ribs and the speaker monomer and between the boss and the speaker monomer.

8. The speaker module according to claim 1, characterized in that, the buckle structures include a connection portion perpendicular to the bottom of the second shell, the connection portion having a transverse elasticity, the end portion of the connection portion being provided with a buckle portion which is perpendicular to the connection portion and extends toward the direction of the speaker monomer, and the buckle portion being buckled on the end face of the speaker monomer.

9. The speaker module according to claim 8, characterized in that, a slot adapted to the buckle portion is provided on the end face of the speaker monomer.

10. A method for assembling the speaker module as claimed in claim 1, characterized by comprising steps of:

S1, providing the first shell and the second shell, and welding the first shell with the second shell as one by ultrasonic process;

S2, mounting the speaker monomer, in a direction downward along a magnetic system, between the two buckle structures from the mounting hole;

S3, coating glue between the speaker monomer and the first shell to seal the front acoustic cavity and the rear acoustic cavity;

S4, placing the third shell at the mounting hole above the speaker monomer, and coating the glue between the third shell and the first shell to perform sealing, thus completing the assembling of the speaker module.

* * * * *